US008689500B2

(12) United States Patent
Clifford

(10) Patent No.: US 8,689,500 B2
(45) Date of Patent: Apr. 8, 2014

(54) SNOW REMOVAL METHOD AND SYSTEM FOR A METAL ROOF

(76) Inventor: Eric B. Clifford, Wolfeboro, NH (US)

( * ) Notice: Subject to any disclaimer, the term of this patent is extended or adjusted under 35 U.S.C. 154(b) by 218 days.

(21) Appl. No.: 13/210,911

(22) Filed: Aug. 16, 2011

(65) Prior Publication Data

US 2013/0042548 A1 Feb. 21, 2013

(51) Int. Cl.
*E04H 14/00* (2006.01)
*E04D 13/10* (2006.01)
*E04D 13/076* (2006.01)

(52) U.S. Cl.
CPC ..... *E04D 13/106* (2013.01); *E04D 13/103* (2013.01); *E04D 13/076* (2013.01); *E04D 13/0762* (2013.01); *E04D 13/0765* (2013.01)
USPC ..... 52/173.1; 219/210; 219/213

(58) Field of Classification Search
CPC . E04D 13/103; E04D 13/106; E04D 13/0762; E04D 13/076; E04D 13/0765
USPC ..... 52/173.1, 171.2, 13, 24; 15/94; 219/210, 69.2, 213
See application file for complete search history.

(56) References Cited

U.S. PATENT DOCUMENTS

| | | | | |
|---|---|---|---|---|
| 2,507,039 | A * | 5/1950 | Miller | 219/213 |
| 3,646,321 | A * | 2/1972 | Siegla | 219/465.1 |
| 4,401,880 | A * | 8/1983 | Eizenhoefer | 219/213 |
| 4,875,644 | A * | 10/1989 | Adams et al. | 244/134 R |
| 5,129,598 | A * | 7/1992 | Adams et al. | 244/134 D |
| 5,496,989 | A * | 3/1996 | Bradford et al. | 219/497 |
| 5,782,435 | A * | 7/1998 | Ingram et al. | 244/134 D |
| 5,786,563 | A * | 7/1998 | Tiburzi | 219/213 |
| 6,348,673 | B2 * | 2/2002 | Winters | 219/213 |
| RE38,024 | E * | 3/2003 | Adams et al. | 244/134 D |
| 6,759,630 | B1 * | 7/2004 | Tenute | 219/213 |
| 6,852,171 | B2 * | 2/2005 | Downs | 134/16 |
| 6,870,139 | B2 * | 3/2005 | Petrenko | 219/482 |
| 7,071,446 | B1 * | 7/2006 | Bench | 219/213 |
| 2009/0224104 | A1 * | 9/2009 | Tenebre et al. | 244/134 R |

* cited by examiner

*Primary Examiner* — William Gilbert
*Assistant Examiner* — James Ference
(74) *Attorney, Agent, or Firm* — Davis & Bujold, PLLC; Michael J. Bujold

(57) ABSTRACT

A method of removing accumulated frozen rain/ice/snow from a metal roof. The method comprising the steps of inducing vibration into the metal roof, via at least one vibration imparting member attached to the metal roof, to break up the frozen rain/ice/snow accumulated on the metal roof and separate the frozen rain/ice/snow from the metal roof; and allowing the frozen rain/ice/snow to slide off the metal roof under an effect of gravity.

20 Claims, 9 Drawing Sheets

4

4

SNOW REMOVAL METHOD AND SYSTEM FOR A METAL ROOF

FIELD OF THE INVENTION

The present invention relates to a method and a system which facilitates removing accumulated frozen rain/ice/snow from a metal roof by inducing vibration into the metal roof which causes the accumulated frozen rain/ice/snow to break and loosen from the metal roof and slide off under to effect of gravity.

BACKGROUND OF THE INVENTION

In northern climates in particular, the accumulation of frozen rain/ice/snow on a roof can present a significant problem to buildings and other structures. This is particularly problematic when snow from a series of sequential snow storms is able to accumulate on the roof of a building or some other structure without the accumulated frozen rain/ice/snow being able to sufficiently melt and/or slide off the roof. Moreover, in the event that the snow is allowed to partially melt but the melted water is unable to adequately drip or flow off of the roof, e.g., possibly become trapped by an ice dam which forms on the roof, this melted water remains on the roof and eventually freezes and thus increases the load which must be supported by the roof of the building or structure.

Moreover, as frequently occurs in northern climates, sometimes rain falls, instead of snow, and such rain generally accumulates on and is absorbed by the snow and frozen rain or ice which has collected and accumulated on the roof. When this occurs, this trapped or absorbed water further increases the load and/or stress on the roof. Such an increase in load on the roof may, in some instances, eventually cause the building or other structure to collapse due to the load of the accumulated frozen rain/ice/snow.

In an attempt to prevent collapse of the roof due to the load of the accumulated frozen rain/ice/snow, building owners will typically attempt to clear off the roof by climbing onto the roof and shoveling or otherwise attempting to remove the accumulated frozen rain/ice/snow from the roof. However, in the event of a metal roof, such roof tends to be slippery, especially when wet or snow covered, and thus it is quite hazardous for a building owner or some other individual to access the metal roof and attempt to shovel or otherwise remove the accumulated frozen rain/ice/snow therefrom. In particular, while attempting to shovel or otherwise remove the accumulated frozen rain/ice/snow from a metal roof, individuals have fallen or slid off from metal roofs and, as a result, have become seriously injured.

SUMMARY OF THE INVENTION

Wherefore, it is an object of the present invention to overcome the above mentioned shortcomings and drawbacks associated with the prior art when attempting to shovel or otherwise remove accumulated frozen rain/ice/snow from metal roof as well as provide a method and a system for consistently and reliably removing accumulated frozen rain/ice/snow from a metal roof.

Another object of the present invention is to provide a method and a system in which an operator can remotely control when and the length of time vibration is induced into the metal roof to cause the metal roof to vibrate in an attempt to free or loosen the accumulated frozen rain/ice/snow from the metal roof and thereby permit the accumulated frozen rain/ice/snow to slide off the roof under the effect of gravity.

A further object of the present invention is to strategically mount and space a plurality of vibration imparting members on an inwardly facing surface of the metal roof so that each vibration imparting member can impart a sufficient vibrational force into a desired area of the metal roof thereby causing that area of the metal roof to sufficiently vibrate and loosen, free and/or separate the accumulated frozen rain/ice/snow from the metal roof so that the accumulated frozen rain/ice/snow can slide off the metal roof due to gravity.

Yet another object of the present invention is to sufficiently space the vibration imparting members from one another so that a desired area of the metal roof can be imparted with a desired vibrational force so as to cause the metal roof to vibrate and thereby remove the accumulated frozen rain/ice/snow therefrom.

A still further object of the present invention is to provide remote control of the method and the system so that an operator can be located either inside or outside of the building or other structure and view the metal roof prior to actuating the vibration imparting members to ensure that the freed accumulated frozen rain/ice/snow does not inadvertently fall on and harm or damage any individual or object or item.

Another object of the present invention is to divide the roof into two or more separate and distinct zones so that the operator can control actuation of the vibration imparting members located within each separate and distinct zone and thereby control the removal of the accumulated frozen rain/ice/snow from the roof in a controlled manner.

The present invention also relates to a method of removing accumulated frozen rain/ice/snow from a metal roof, the method comprising the steps of inducing vibration into the metal roof, via at least one vibration imparting member attached to the metal roof, to break up the frozen rain/ice/snow accumulated on the metal roof and separate the frozen rain/ice/snow from the metal roof; and allowing the frozen rain/ice/snow to slide off the metal roof under an effect of gravity.

The present invention also relates a snow removal system for removing accumulated frozen rain/ice/snow from a metal roof, the snow removal system comprising: at least one vibration imparting member (4) being fixed to an inwardly facing surface (6) of the metal roof (8); a power source (14) being in coupled to the at least one vibration imparting member (4); and a control unit (16) communicating with the power source (14), and the control unit (16) controlling a flow of energy from the power source (14) to the at least one vibration imparting member (4) and actuating the at least one vibration imparting member (4) such that vibration is imparted by the at least one vibration imparting member (4) to break up and separate the accumulated frozen rain/ice/snow from the metal roof (8) and slide off the metal roof (8) due to gravity

BRIEF DESCRIPTION OF THE DRAWINGS

The invention will now be described, by way of example, with reference to the accompanying drawings in which.

DETAILED DESCRIPTION OF THE INVENTION

Figure 1:
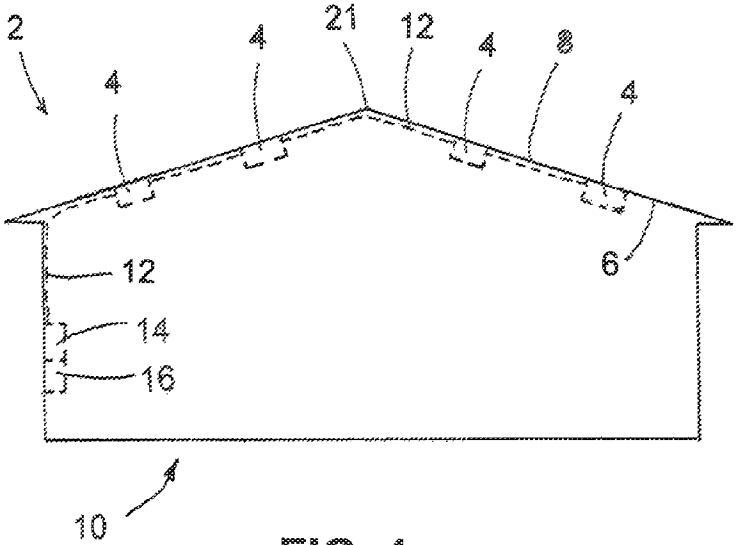
FIG. 1 is a diagrammatic side elevational view of a building incorporating the vibration imparting members according to the present invention.

Turning now to FIG. 1, a brief description concerning the various components of the present invention will now be briefly discussed. Initially a discussion concerning the purpose and the function of the vibration imparting members 4 of the snow removal system 2 will be provided and this will then be followed by a detailed discussion of one embodiment of the vibration imparting member 4.

Figure 7:
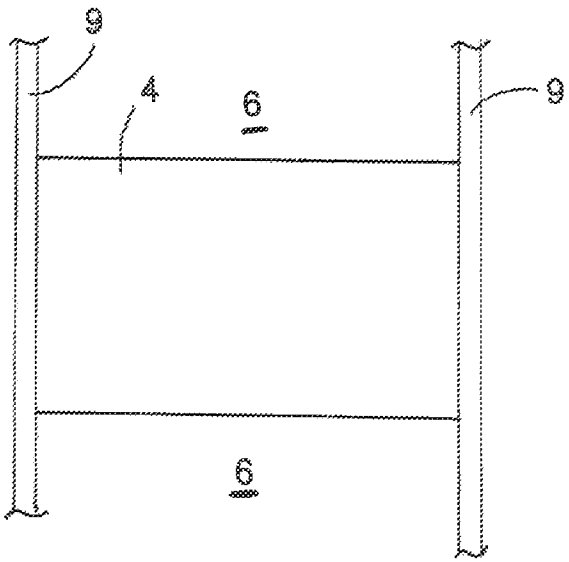
FIG. 7 is a diagrammatic bottom view of a vibration imparting member retained in contact with the metal roof between two beams.

As shown in FIG. 1, the snow removal system 2 generally comprises a plurality of spaced apart vibration imparting members 4 which are each mounted and supported on an inwardly facing surface 6 of a metal roof 8 of a building or other structure 10. The vibration imparting members 4 are mounted to the inwardly facing surface 6 by gluing the bottom surface of the vibration imparting member 4 directly to the inwardly facing surface 6. It is to be appreciated that the vibration imparting members 4, as shown in FIG. 7, may be fixed to and located between two beams, rafters, trusses or other roof support 9 such that the vibration imparting members 4 contact with the inwardly facing surface 6 of the metal roof 8. The vibration imparting members 4 may be retained in contact with the inwardly facing surface 6 of the metal roof 8 by way of any other conventional mounting technique. The important aspect is that the seasaw hammers, of the vibration imparting member 4, be able to directly contact the inwardly facing surface 6 of the metal roof 8 for imparting vibration energy thereto, as will be discussed below.

Figure 2:
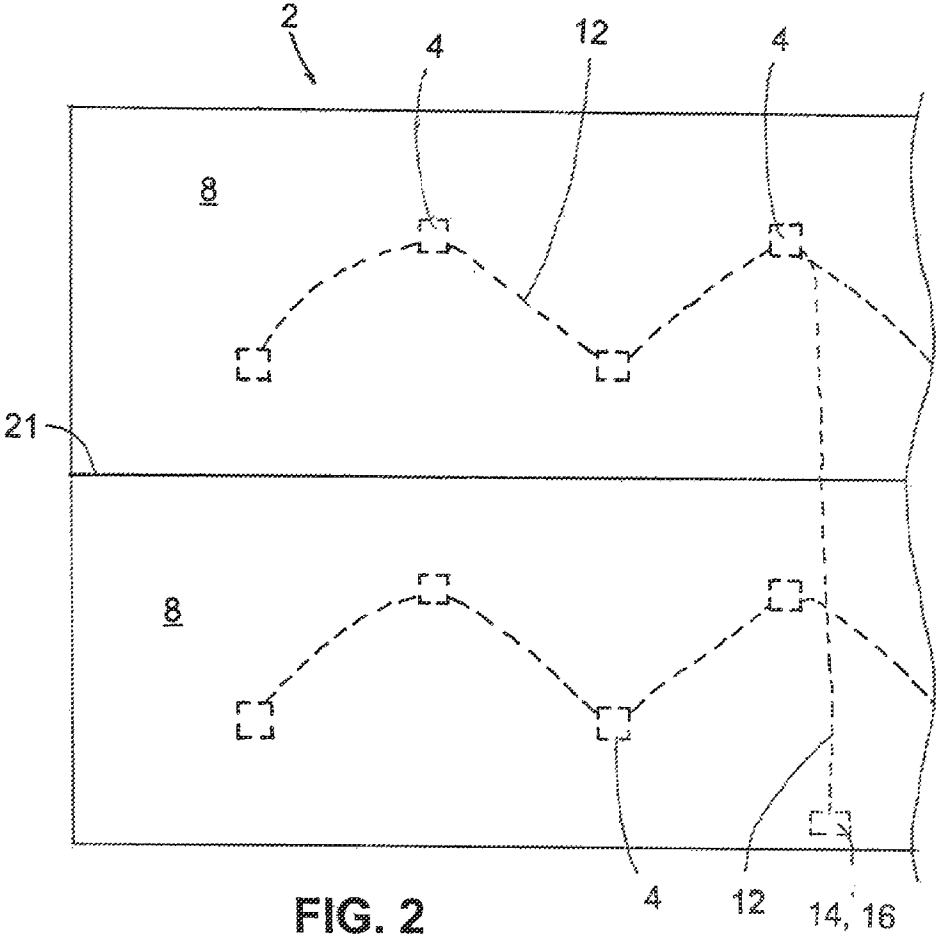
FIG. 2 is a diagrammatic top plan view of a portion of the building of FIG. 1 with the vibration imparting members arranged in a first configuration.
Figure 2A:
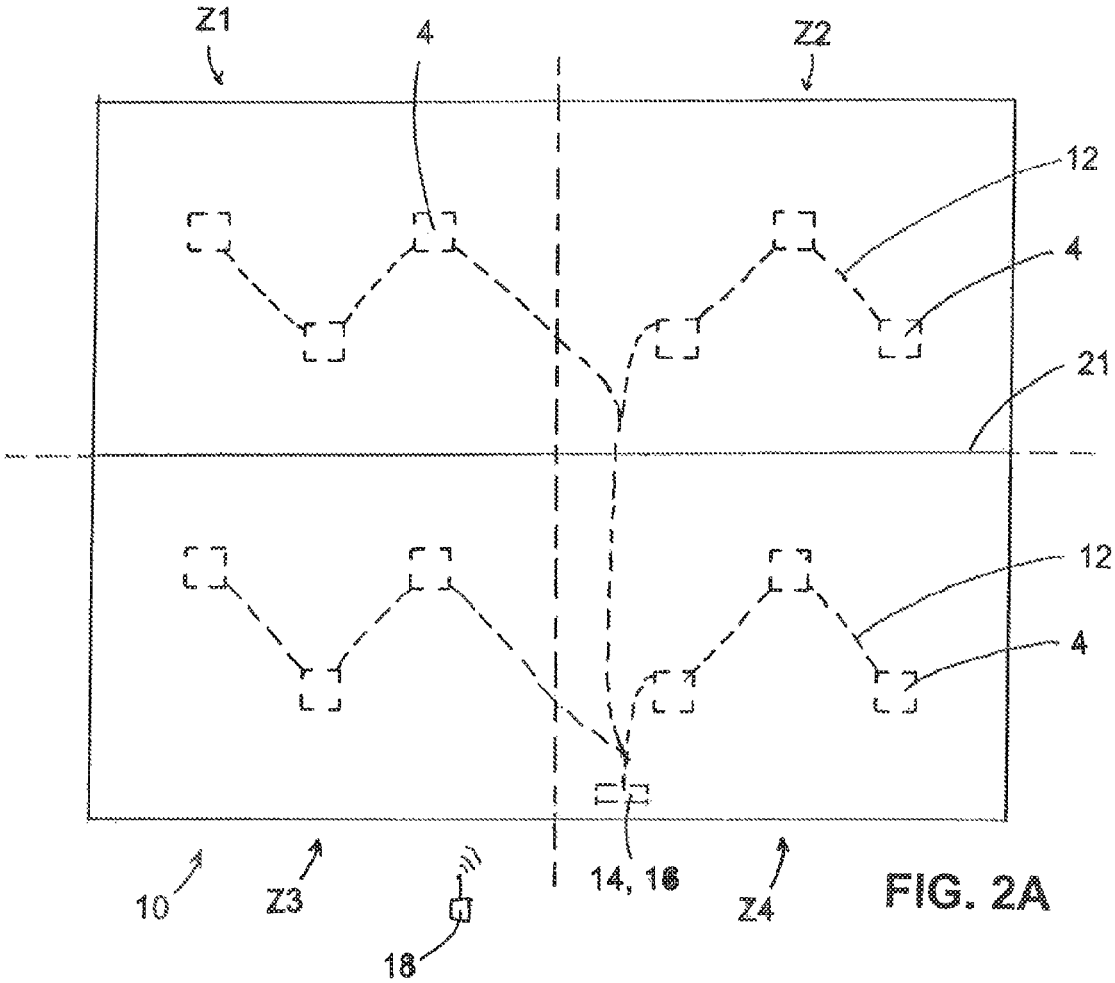
FIG. 2A is a diagrammatic top plan view of the building of FIG. 1 with the vibration imparting members divided into vibration zones for sequential actuation.
Figure 2B:
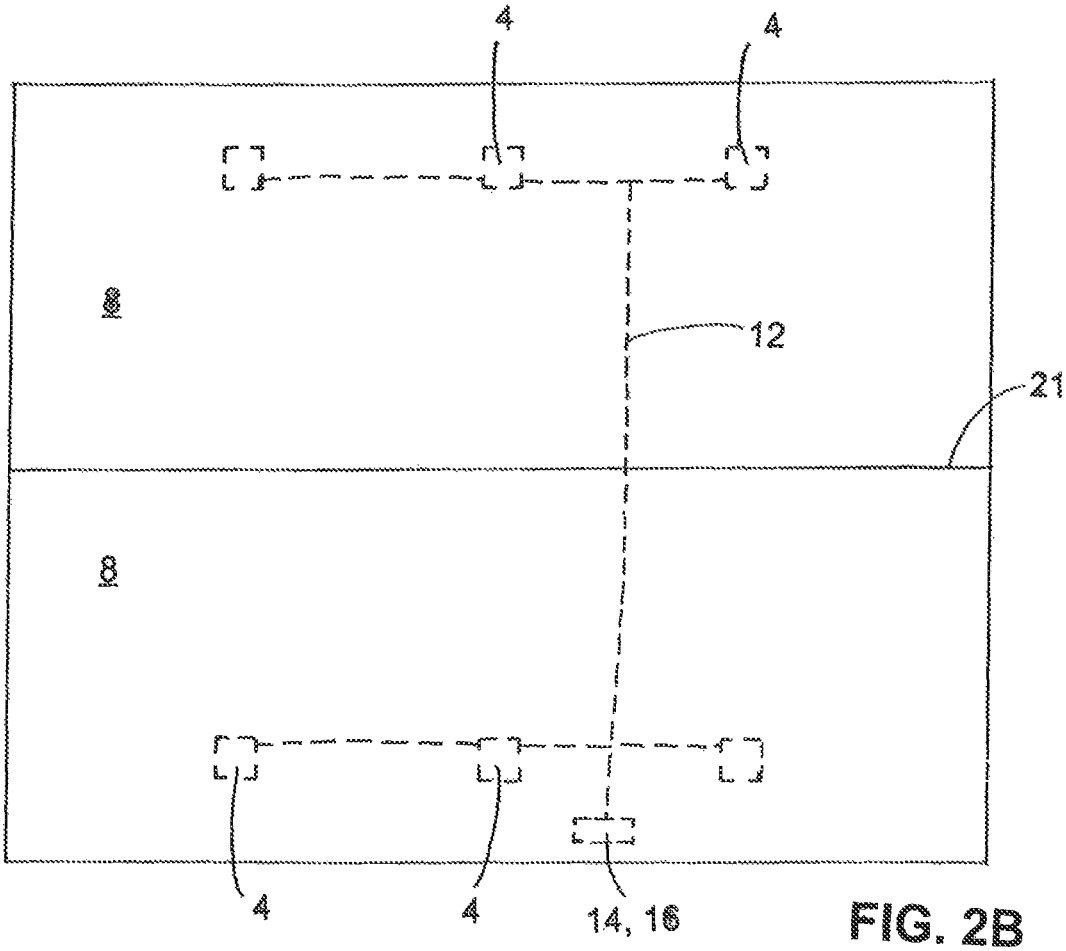
FIG. 2B is a diagrammatic top plan view of a portion of the building of FIG. 1 with the vibration imparting members arranged in a third configuration.

Each one of the vibration imparting members 4 is electrically connected, via conventional electrical cord or wiring 12, to a power source 14 for electrically powering each one of the vibration imparting members 4 with sufficient electrical power. As shown in FIGS. 2, 2A and 2B any number of vibration imparting members 4 may be mounted and supported by the inwardly facing surface 6 of the metal roof 8 of the building 10 in a spaced relationship from one another and interconnected with the power source 14 by the electrical wiring 12.

Typically, the power source 14 is accommodated in or is part of a control panel 16 which controls the flow of electrical power to each one of the vibration imparting members 4. According to this embodiment, when the control panel 16 is activated by an operator, either the operator depressing a start button or remotely controlling operation the same by a remote control unit, the electrical power flows from the power source 14 along the electrical wires 12 to each one of the vibration imparting members 4 so that all of the vibration imparting members 4 are simultaneously activated with one another. That is, each one of the vibration imparting members 4, once energized with electrical power, induces a vibration into the metal roof 8 of the building 10 thereby causing the metal roof 8 to vibrate and, in turn, typically causing the engagement between the accumulated frozen rain/ice/snow and the metal roof 8 of the building 10 to loosen or break so that the accumulated frozen rain/ice/snow can thereafter slide off the metal roof 8 to the ground, under the effect of gravity, and thereby clear the metal roof 8 of the accumulated frozen rain/ice/snow.

According to a preferred embodiment of the invention, each one of the vibration imparting members 4 is preferably directly attached to a bottom inwardly facing surface of the metal roof 8. In this manner, each vibration imparting member 4 can directly contact and engage with the metal roof 8 and cause the same to vibrate and thereby break or free the engagement between the accumulated frozen rain/ice/snow and the metal roof 8.

FIGS. 2, 2A and 2B show the vibration imparting members 4 arranged with respect to the metal roof 8 in a variety of different configurations. It is to be appreciated that one could arrange the vibration imparting members 4 on the inwardly facing surface 6 of the roof 8 in virtually an infinite number of configurations. The arrangement of the vibration imparting members 4 can depend on the seasonal average of frozen rain/ice/snow accumulation, the number of vibration imparting members 4 to be utilized in the snow removal system 2 and related specifications of the metal roof 8, e.g., the maximum amount of weight that can be supported by the metal roof 8. FIG. 2 shows only a portion of the metal roof 8 of the building 10 and the snow removal system 2 supported thereby, to illustrate the fact that the snow removal system 2 is expandable. For example, more vibration imparting members 4 can be simply added to an existing snow removal system 2 as additions are made to the building 10. In the embodiment of the snow removal system 2 as shown in FIG. 2A, the vibration imparting members 4 are divided into a plurality of separate sections or zones Z1, Z2, Z3 and Z4. As will now be discussed, in larger sized buildings 10, the metal roof 8 has a greater surface area, in such cases the metal roof 8 may be divided into four or more separate zones Z1, Z2, Z3 and Z4. FIG. 2A shows the metal roof 8 being divided into zones Z1, Z2, Z3 and Z4 by means of imaginary dashed lines. The metal roof 8 of building 20 is divided in two inclined sides by the peak 21 of the roof 8, with two zones being located on each inclined side of the metal roof 8 of the building 10. In addition, a remote control device 18, for remotely actuating the control panel 16, is provided. The operator can carry the remote control device 18 outside of the building 10 and view the metal roof 8. As a result of such arrangement, the operator can then sequentially control operation of the control panel 16 so that each zone Z1, Z2, Z3 and Z4 can be individually actuated to sequentially vibrate and break and free the accumulated frozen rain/ice/snow from the metal roof 8. In addition, since the operator is located outside of the building 10, the snow removal operation is in plain view of the operator and this tends to improve the safety of removing the accumulated frozen rain/ice/snow from the metal roof 8, e.g., avoids the accumulated frozen rain/ice/snow from inadvertently falling on somebody entering the building 10 or on any object or item, etc.

The operator will then sequentially actuate the vibration imparting members 4, via the remote control device 18, in each one of the four zones Z1, Z2, Z3 and Z4 until all of the accumulated frozen rain/ice/snow is loosened and freed from the metal roof 8. It will be appreciated that one or more zones Z1, Z2, Z3 and Z4 may be vibrated for a longer duration of time in an attempt to remove the accumulated frozen rain/ice/snow therefrom, further one or more zones Z1, Z2, Z3 and Z4 may be repeatedly vibrated over the course of the day or few days in an attempt to remove the accumulated frozen rain/ice/snow therefrom. The inventor has found that the combination of vibration as well as warm temperature from the sun is generally adequate to free the accumulated frozen rain/ice/snow from virtually any metal roof 8 without the need of climbing up onto the metal roof 8 to manually remove the accumulated frozen rain/ice/snow therefrom.

Figure 3:
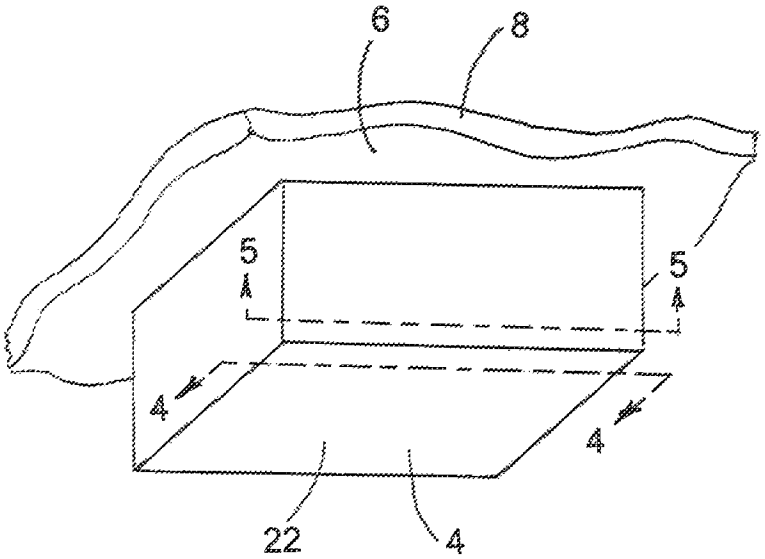
FIG. 3 is a diagrammatic isometric view of one of the vibration imparting members secured to an inwardly facing surface of a metal roof.
Figure 4:
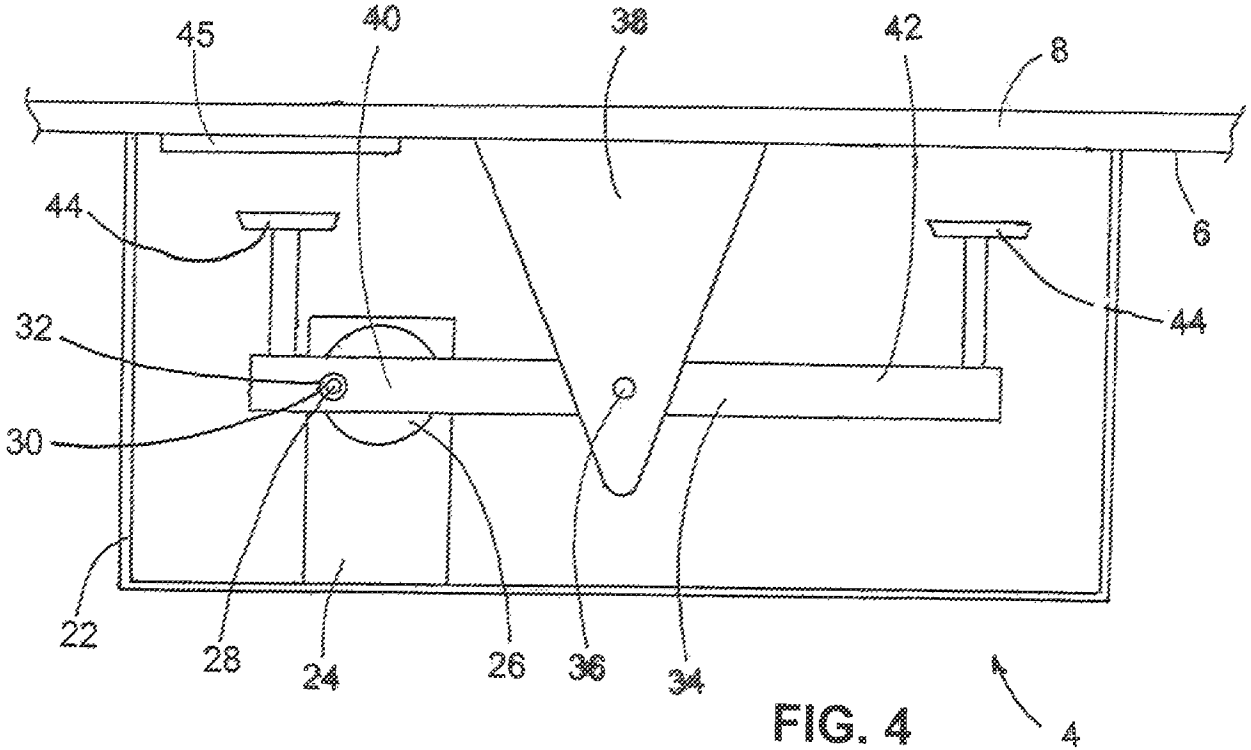
FIG. 4 is a diagrammatic side view along section line 4-4 of FIG. 3 showing a cam, a motor and a seasaw hammer of the vibration is imparting member.
Figure 5:
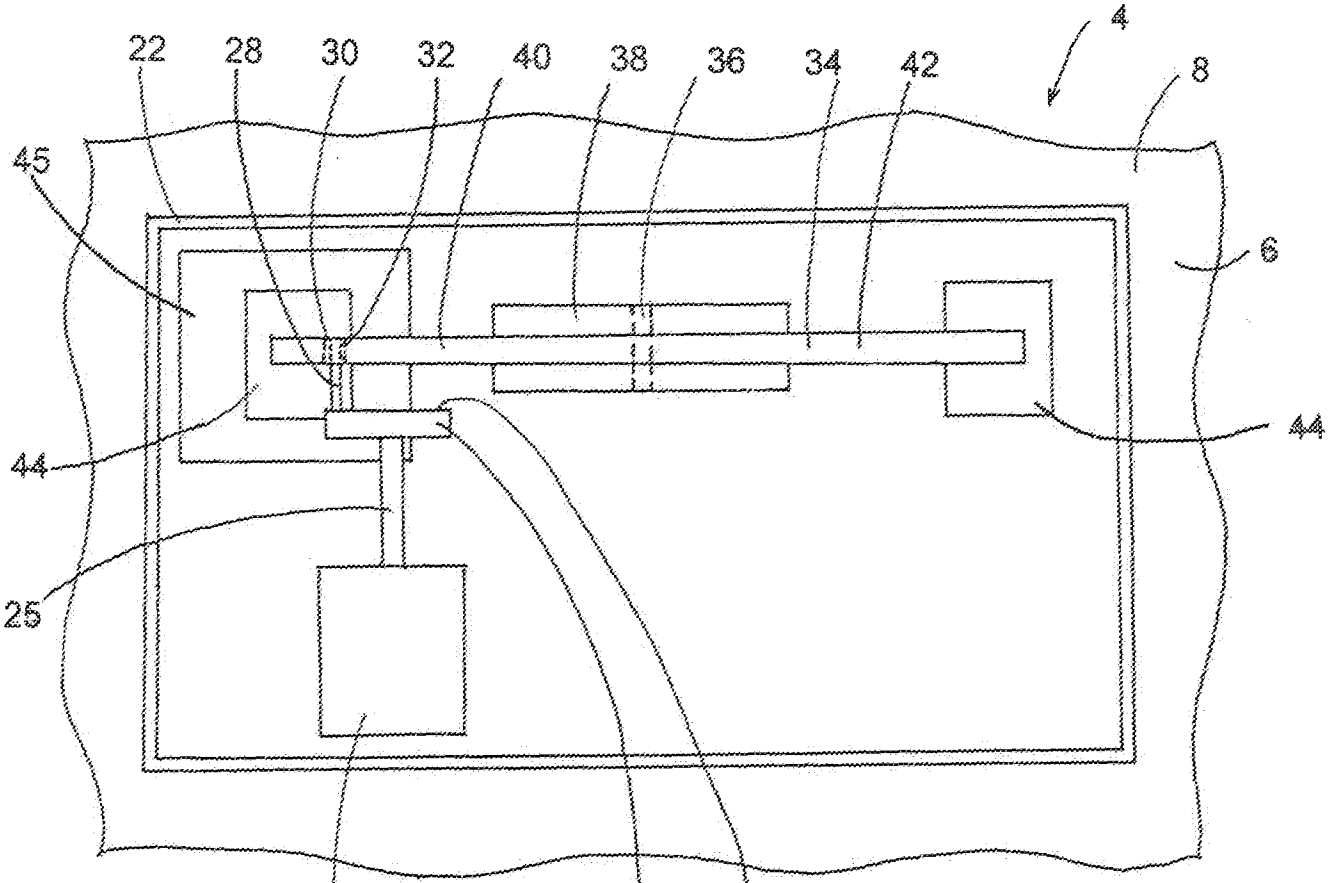
FIG. 5 is a diagrammatic bottom view along section line 5-5 of FIG. 3 showing the vibration imparting member.

Turning now to FIGS. 3-5, a detailed description concerning one embodiment of the vibration imparting member 4 will now be provided. The vibration imparting member 4 is simply diagrammatically shown fixed to the inwardly facing surface 6 of a portion of the metal roof 8. As shown in this embodiment, the vibration imparting member 4 generally comprises an exterior housing 22 which accommodates a motor 24 therein. The motor 24 drives a first end of a drive shaft 25 while the opposite end of the drive shaft 25 supports a cam 26. A drive pin 28 is supported on an exterior surface 27 of the cam 26 and the drive pin 28 engages with an aperture 30 of a cylindrical bearing 32 carried by the seasaw hammer 34. The seesaw hammer 34 is centrally pivoted, at 36, by a pivot arm 38 which is directly mounted to either the vibration imparting member 4 or to the metal roof 8. The seesaw hammer 34 comprises both a left arm 40 and a right arm 42 and each one of these arms supports a resilient member 44 at a free end thereof. During cyclical movement of the seesaw hammer 34, as will be discussed below, the resilient members 44 can be brought into striking engagement directly with the inwardly facing surface 6 of the metal roof 8 such as would happen with the resilient member 44 of the right arm 42 (only shown in FIG. 4) or the resilient members 44 can be brought into striking engagement, via a strike plate or pad (e.g., a rubber pad or some other impact absorbing plate, pad, surface, etc.) 45, with the inwardly facing surface 6 of the metal roof 8 such as would happen with the resilient member 44 of the left arm 40 and thereby induce vibration into the metal roof 8. The use of a strike plate or pad 45 to induce vibration into the metal roof 8 may be beneficial so as to disperse the impact force from the resilient member 44 over a greater area of the metal roof 8. If the strike plate or pad 45 were to be utilized in the snow removal system 2, these would be fixed directly to the inwardly facing surface 6 of the metal roof 8 by any known means, e.g., adhesive, screws or bolts.

Figure 6A:
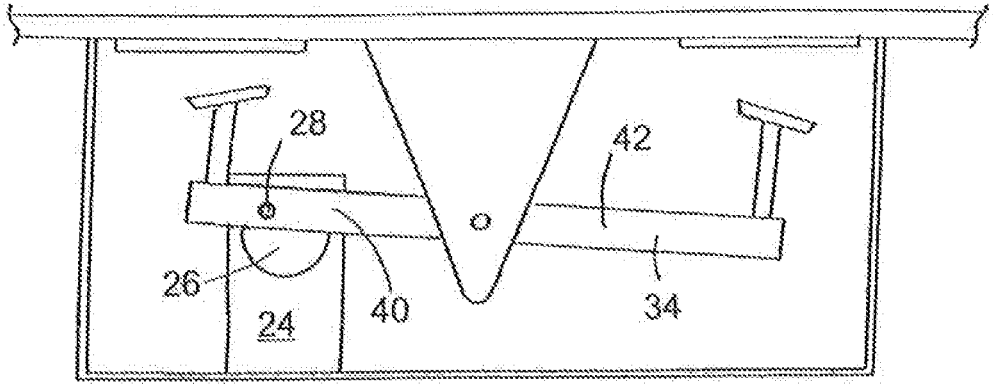
FIG. 6A is a diagrammatic view, similar to FIG. 4, showing the seasaw hammer, which is driven by the cam and the motor of the vibration imparting member, in an intermediate position moving toward a left arm striking position.

With reference first to FIG. 6A, the seasaw hammer 34 is shown in an intermediate position where the left arm 40 is being directed toward the metal roof 8. As the motor 24 drives the cam 26, the drive pin 28 in turn rotates along with the cylindrical bearing 32 and such rotation of the cylindrical bearing 32 in turn moves the seesaw hammer 34 to the intermediate position shown in FIG. 6A where the left arm 40 is closer to the inwardly facing surface 6 of the metal roof 8 than the right arm 42. As the motor 24 continues to drive the cam 26, the drive pin 28 rotates along with the cylindrical bearing 32 and such rotation of the cylindrical bearing 32 in turn moves the left arm 40 of the seesaw hammer 34 to striking position shown in FIG. 6B where the resilient member 44 of the left arm 40 of the seesaw hammer 34 is forced into abutting engagement either directly with the metal roof 8 or with the strike plate or pad 45 fixed to the inwardly facing surface 6 of the metal roof 8 and thereby causes the metal roof 8 to vibrate.

Figure 6C:
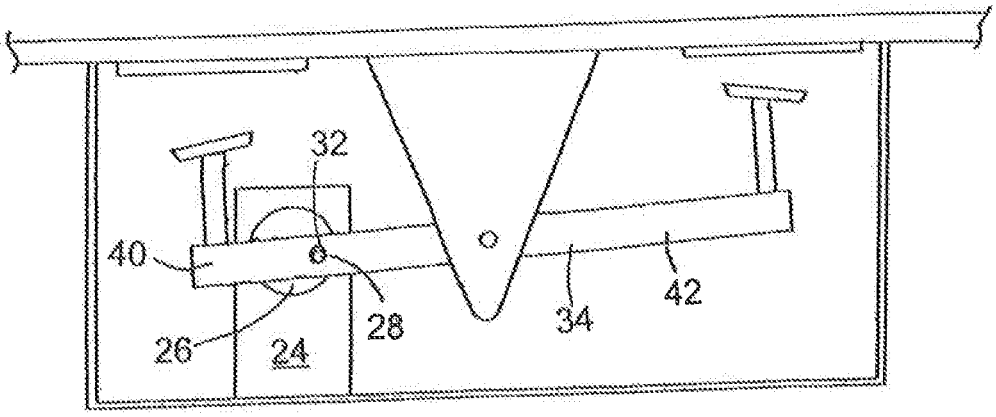
FIG. 6C is a diagrammatic view, similar to FIG. 4, showing the seasaw hammer in an intermediate position moving toward a right arm striking position.
Figure 6B:
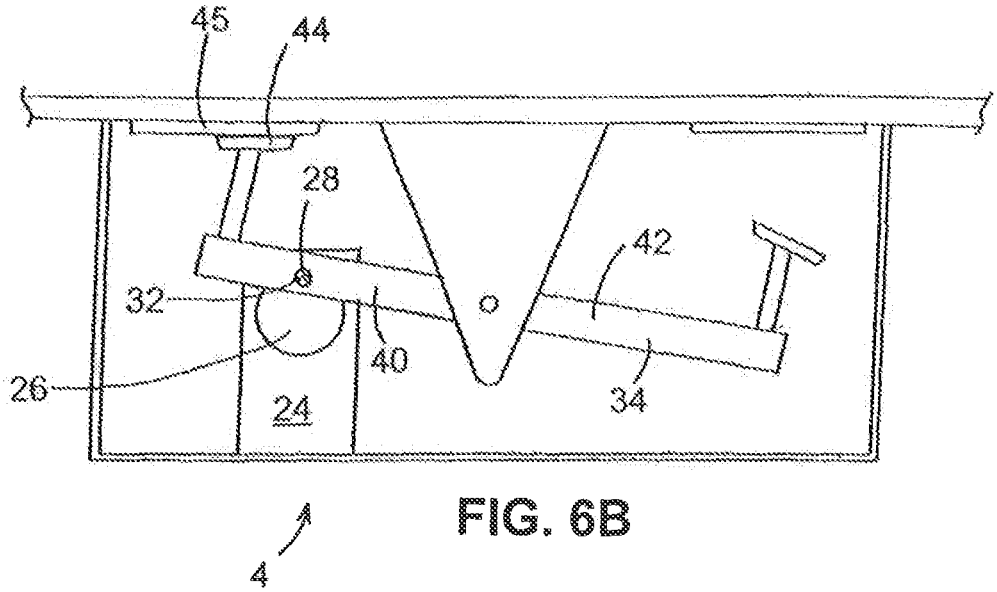
FIG. 6B is a diagrammatic view, similar to FIG. 4, showing the seasaw hammer in a left arm striking position.
Figure 6D:
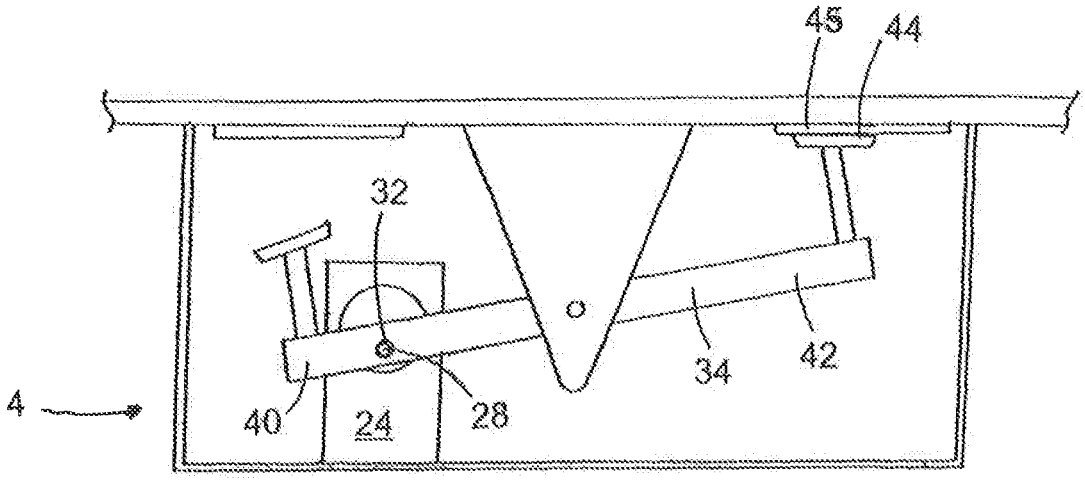
FIG. 6D is a diagrammatic view, similar to FIG. 4, showing the seasaw hammer in a right arm striking position.

As the motor 24 continues to drive the cam 26, the drive pin 28 rotates along with the cylindrical bearing 32 and such rotation of the cylindrical bearing 32 in turn moves the seesaw hammer 34 to the intermediate position shown in FIG. 6C where both the left and the right arms 40, 42 are again spaced from the inwardly facing surface 6 of the metal roof 8. As the motor 24 continues to drive the cam 26, the drive pin 28 rotates along with the cylindrical bearing 32 and such rotation of the cylindrical bearing 32 in turn moves the seesaw hammer 34 to the right arm 42 striking position, shown in FIG. 6D, where the resilient member 44 of the right arm 42 of the seesaw hammer 34 is forced into abutting engagement either directly with the metal roof 8 or with the strike plate or pad 45 fixed to the inwardly facing surface 6 of the metal roof 8 and thereby causes the metal roof 8 to vibrate.

Figure 8:
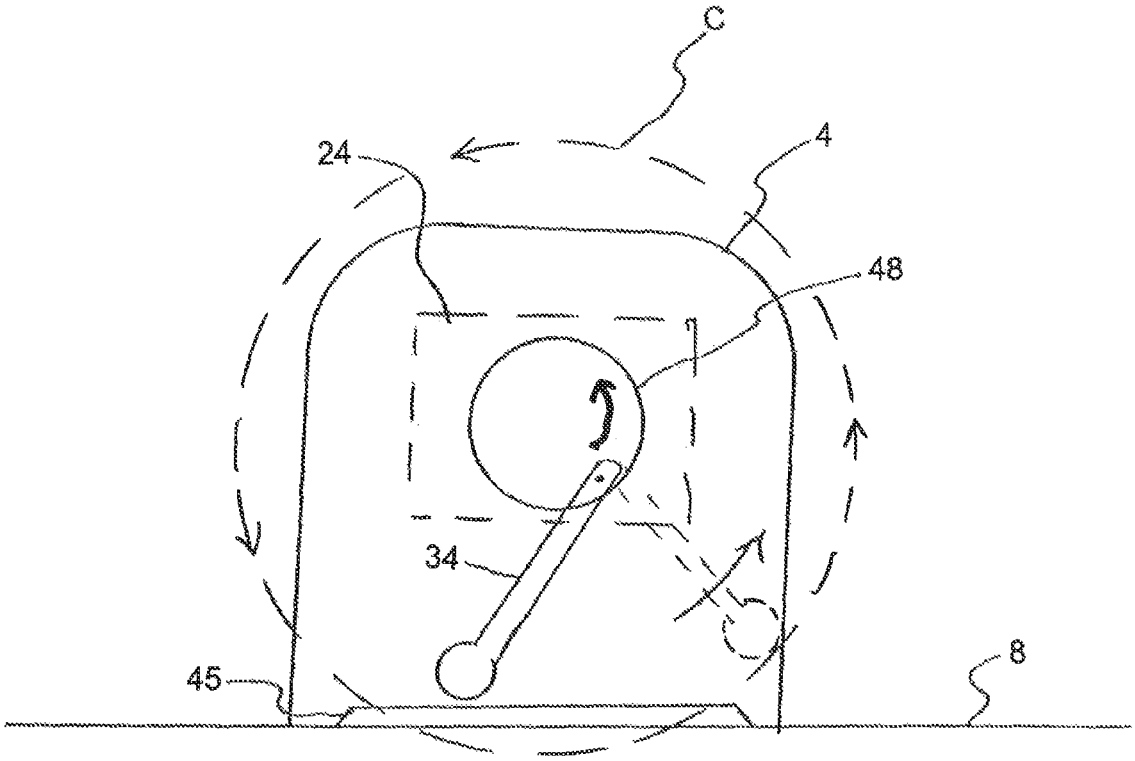
FIG. 8 is a diagrammatic bottom a further embodiment of the vibration imparting member.

With reference to FIG. 8, a further embodiment of the vibration imparting member 4 will now be briefly described. According to this embodiment, only a single arm 34 is attached to and driven by a drive device or a motor 24. That is, the single arm 34 is pivoted pivotally attached to the free end of the shaft 48 which is driven by the motor 24 so as to rotate in only one rotational direction, e.g., in either a clockwise or a counterclockwise direction. As the single arm 34 rotates and strikes the rubber pad or plate 45, affixed to the metal roof 8, the single arm 34 is pivoted relative to the free end of the shaft 48 so as to allow the necessary clearance for the single arm 34 to rotate and pass between the free end of the shaft 48 and the metal roof 8 and thereby continue rotating in the same direction for a further strike against the metal roof 8 and thereby induce the desired vibration directly into the bottom surface of the metal roof 8. As soon as the single arm 34 clears the rubber pad or plate 45, the single arm 34 can then pivot radially outward away from the free end of the shaft 48 to a maximum circumferential distance C which ensures a striking engagement between the free hammer end 44 of the single arm 34 and the pad or plate 45 affixed to the metal roof 8.

The above procedure is repeated many times a second to induce the desired vibrational energy into the metal roof 8 and cause the metal roof 8 to sufficiently vibrate and thereby break free from and loosen the accumulated frozen rain/ice/snow from the metal roof 8. Preferably each one of the vibration imparting members 4 will induce the metal roof 8 to vibrate at a frequency of between about 5 hertz and about 1400 hertz, more preferably between about 20 hertz and about 360 hertz. In addition, each one of the vibration imparting members 4 will vibrate for duration of time between about 5 seconds and about 20 minutes, more preferably between about 30 seconds and about 10 minutes.

Typically each one of the vibration imparting members 4 is capable of vibrating a section of the metal roof 8 having an area of between about 25 square feet and about 400 square feet, more preferably between about 50 square feet and about 250 square feet, and most preferably between about 75 square feet and about 150 square feet. Accordingly, depending upon the size of the metal roof 8, the vibration imparting members 4 will be spaced from one another by a sufficient distance, typically between about 6 feet and about 15 feet from one another, to ensure that each section of the metal roof 8 is sufficiently vibrated so as to free or loosen the engagement between the metal roof and the accumulated frozen rain/ice/snow.

Preferably each one of the vibration imparting member is coupled, in a conventional manner (e.g., either hardwired or includes a wireless receiver which communicates with the remote control device), with the (remote) control device so that each one of the vibration imparting members 4 can be individually actuated by the (remote) control device as necessary. This is particularly advantageous when one particular area or region of the metal roof has accumulated frozen rain/ice/snow which is not easily removed from the metal roof 8 and thus that particular area or region must be repeatedly vibrated in order to break the accumulated frozen rain/ice/snow free from the metal roof 8. This allows the vibrational energy to be directed to the particular area or region where it is required.

It is to be appreciated that the free hammer end 44 of the arms 34, 42 may be coated or otherwise provided with an exterior covering or layer so that as the hammer ends 44 of the arms 34, 42 strike and contact against the bottom surface of the metal roof 8, they do not cause damage to the metal roof 8 but merely transfer and impart the desired vibration into the metal roof 8. In such instance, use of a separate pad or plate 45 may be avoided. Alternatively, the pad or plate 45 may be include elongate plates, rods or members (not shown) which are embedded therein for distributing the impact force of the hammer ends 44 over a greater surface area of the metal roof 8 and thereby further assist with breaking and freeing the accumulated frozen rain/ice/snow free from the metal roof 8.

In the above description and appended drawings, it is to be appreciated that only the terms "consisting of" and "consisting only of" are to be construed in the limitative sense while of all other terms are to be construed as being open-ended and given the broadest possible meaning.

Since certain changes may be made in the above described improved method and system for facilitating removal of snow from a metal roof without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A snow removal system for removing accumulated frozen rain, ice or snow from a metal roof, the snow removal system comprising:

at least one vibration imparting member being fixed to an inwardly facing surface of the metal roof;

a power source being coupled to supply electrical power to the at least one vibration imparting member; and a control unit communicating with the power source, and the control unit controlling a flow of energy from the power source to the at least one vibration imparting member and actuating the at least one vibration imparting member such that vibration is imparted, by the at least one vibration imparting member, to the metal roof to break up and separate the accumulated frozen rain, ice or snow from the metal roof so that the accumulated frozen rain, ice or snow slides off the metal roof due to the vibration and gravity;

wherein the at least one vibration imparting member comprises a motor which supports a rotatable cam which facilitates imparting vibration to the metal roof to at least partially break up and separate the accumulated frozen rain, ice or snow from the metal roof.

2. The snow removal system according to claim 1, wherein the at least one vibration imparting member comprises a plurality of vibration imparting members attached to the inwardly facing surface of the metal roof at spaced locations for vibrating the metal roof.

3. The snow removal system according to claim 2, wherein the plurality of vibration imparting members are actuated for a duration of time of between about 5 seconds and about 20 minutes.

4. The snow removal system according to claim 2, wherein the plurality of vibration imparting members are divided in to at least two separate zones, and the at least two separate zones are able to be actuated, independently of one another, for removing the frozen rain, ice or snow from the metal roof.

5. The snow removal system according to claim 4, the plurality of vibration imparting members, in the at least two separate zones, are coupled to remote a control device which is operable by an operator for removing the accumulated frozen rain, ice or snow from the metal roof.

6. The snow removal system according to claim 2, wherein the plurality of vibration imparting members each operate at a frequency between about 5 hertz and about 1400 hertz.

7. The snow removal system according to claim 2, wherein the plurality of vibration imparting members operate for a duration of time of between about 5 seconds and about 20 minutes.

8. The snow removal system according to claim 2, wherein each of the plurality of vibration imparting members comprises a motor which supports a rotatable cam, both the motor and the rotatable cam are accommodated within a respective housing, each respective housing is directly connected to the inwardly facing surface of the metal roof with at least the rotatable cam spaced from the metal roof, and a resilient member, which transfers the vibration to the metal roof to break up and separate the accumulated frozen rain, ice or snow, is located between the rotatable cam and the metal roof.

9. The snow removal system according to claim 1, wherein the at least one vibration imparting member vibrates at a frequency between about 5 hertz and about 1400 hertz.

10. The snow removal system according to claim 1, wherein the rotatable cam is coupled to a drive shaft, in an offset manner, so that rotation of the cam facilitates imparting vibration to the metal roof to at least partially break up and separate the accumulated frozen rain, ice or snow from the metal roof.

11. The snow removal system according to claim 1, wherein the at least one vibration imparting member further comprises a resilient member which transfers the vibration to the metal roof to break up and separate the accumulated frozen rain, ice or snow from the metal roof.

12. A snow removal system for removing accumulated frozen rain, ice or snow from a metal roof, the snow removal system comprising:

a plurality of vibration imparting members each being fixed to an inwardly facing surface of the metal roof, at spaced locations, for vibrating the metal roof;

a power source being coupled to supply electrical power to the each of the plurality of vibration imparting members; the a control unit communicating with the power source, and the control unit controlling a flow of energy from the power source to each of the plurality of vibration imparting members and actuating the plurality of vibration imparting members such that vibration is imparted, by at least selective ones of the plurality of vibration imparting members, to the metal roof to break up and separate the accumulated frozen rain, ice or snow from the metal roof so that the accumulated frozen rain, ice or snow slides off the metal roof due to the vibration and gravity;

wherein each of the plurality of vibration imparting members comprises a motor which supports a rotatable cam, both the motor and the rotatable cam are accommodated within a respective housing, and the housing is directly connected to the inwardly facing surface of the metal roof with at least the rotatable cam spaced from the metal roof.

13. The snow removal system according to claim 12, wherein each of the plurality of vibration imparting members vibrates at a frequency between about 5 hertz and about 1400 hertz.

14. The snow removal system according to claim 12, wherein the plurality of vibration imparting members are actuated for a duration of time of between about 5 seconds and about 20 minutes.

15. The snow removal system according to claim 12, wherein the plurality of vibration imparting members are divided in to at least two separate zones, and the at least two separate zones are able to be actuated, independently of one another, for removing the frozen rain, ice or snow from the metal roof.

16. The snow removal system according to claim 15, the plurality of vibration imparting members, in the at least two separate zones, are coupled to remote a control device which is operable by an operator for removing the accumulated frozen rain, ice or snow from the metal roof.

17. The snow removal system according to claim 12, wherein each of the plurality of vibration imparting further comprises a resilient member which transfers the vibration to the metal roof to break up and separate the accumulated frozen rain, ice or snow from the metal roof.

18. The snow removal system according to claim 12, wherein the rotatable cam is coupled to a drive shaft, in an offset manner, so that rotation of the cam facilitates imparting vibration to the metal roof to at least partially break up and separate the accumulated frozen rain, ice or snow from the metal roof.

19. The snow removal system according to claim 18, wherein the plurality of vibration imparting members operate for a duration of time of between about 5 seconds and about 20 minutes.

20. A snow removal system for removing accumulated frozen rain, ice or snow from a metal roof, the snow removal system comprising:

a plurality of vibration imparting members each being fixed to an inwardly facing surface of the metal roof;

a power source for supplying electrical power to the plurality of vibration imparting members;

a control unit communicating with the power source, and the control unit controlling a flow of energy from the power source to the plurality of vibration imparting members and actuating the plurality of vibration imparting members such that vibration is imparted, by the plurality of vibration imparting members, to the metal roof to break up and separate the accumulated frozen rain, ice or snow from the metal roof so that the accumulated frozen rain, ice or snow slides off the metal roof due to gravity;

the plurality of vibration imparting members being attached to the metal roof at spaced locations for vibrating the metal roof, the plurality of vibration imparting members each vibrating at a frequency between about 5 hertz and about 1400 hertz, for a duration of time of between about 5 seconds and about 20 minutes and operating at a frequency between about 5 hertz and about 1400 hertz;

each of the plurality of vibration imparting members comprising a motor which supports a rotatable cam, and rotation of the cam facilitates imparting vibration to the metal roof to break up and separate the accumulated frozen rain, ice or snow from the metal roof, the rotatable cam being coupled to a drive motor in an offset manner so as to facilitate imparting vibration to the metal roof;

both the motor and the rotatable cam being accommodated within a respective housing, and each housing being directly connected to the inwardly facing surface of the metal roof; and each of the plurality of vibration imparting members further comprising a resilient member for transferring the vibration to the metal roof.

* * * * *